US006732819B2

(12) United States Patent
Wenzel

(10) Patent No.: US 6,732,819 B2
(45) Date of Patent: May 11, 2004

(54) MUDSAVER VALVE WITH RETRIEVABLE INNER SLEEVE

(76) Inventor: William Ray Wenzel, 1738 Kensit Place, Edmonton, Alberta (CA), T6L 6X7

( * ) Notice: Subject to any disclaimer, the term of this patent is extended or adjusted under 35 U.S.C. 154(b) by 0 days.

(21) Appl. No.: 10/309,381

(22) Filed: Dec. 2, 2002

(65) Prior Publication Data

US 2003/0102131 A1 Jun. 5, 2003

(30) Foreign Application Priority Data

Dec. 3, 2001 (CA) ..... 2364348

(51) Int. Cl.[7] ..... E21B 21/01; E21B 34/00
(52) U.S. Cl. ..... 175/218; 175/318
(58) Field of Search ..... 175/218, 317, 175/318, 324

(56) References Cited

U.S. PATENT DOCUMENTS 3,698,411 A * 10/1972 Garrett ..... 137/71
3,738,436 A * 6/1973 Litchfield et al. ..... 175/65
4,364,407 A * 12/1982 Hilliard ..... 137/71
4,625,755 A * 12/1986 Reddoch ..... 137/327
4,658,905 A * 4/1987 Burge ..... 166/373
4,899,837 A * 2/1990 Baugh ..... 175/218
4,955,949 A * 9/1990 Bailey et al. ..... 137/71
4,962,819 A 10/1990 Bailey et al. ..... 175/218
5,918,673 A * 7/1999 Hawkins et al. ..... 166/285

* cited by examiner

*Primary Examiner*—Hoang Dang
(74) *Attorney, Agent, or Firm*—Christensen O'Connor Johnnson Kindness PLLC

(57) ABSTRACT

A mudsaver valve with retrievable inner sleeve. An annular piston is secured to a first end of the inner sleeve such that movement of the annular piston results in movement of the inner sleeve between a valve closed position and a valve open position. In the valve closed position radial outlet passages of the inner sleeve are blocked by a flow control sleeve. In the valve open position the inner sleeve is moved relative to the flow control sleeve so that the radial outlet passages are no longer blocked. The inner sleeve is maintained in the valve closed position until pump pressure acting upon the annular piston overcomes a biasing force of a biasing spring causing the inner sleeve to be carried by the annular piston to the valve open position.

14 Claims, 2 Drawing Sheets

MUDSAVER VALVE WITH RETRIEVABLE INNER SLEEVE

FIELD OF THE INVENTION

The present invention relates to a mud saver valve which allows the downward flow of drilling mud but closes when pumping is interrupted to retain mud within the drill string.

BACKGROUND OF THE INVENTION

U.S. Pat. No. 4,962,819 (Bailey et al 1990) describes the utility of inserting into a drill string, between a kelly and drill pipe, a mudsaver valve. Such a mudsaver valve saves in mud costs, reduces pollution and provides a safer working environment for rig workers. With prior art mudsaver valves a closure plug at a lower end of the mudsaver valve would tend to leak after becoming eroded and worn. The closure plug could not be repaired and eventually had to be replaced. The Bailey et al reference taught how to make the mudsaver valve repairable through the use of an inner sleeve supported within an upper end of the mudsaver valve by retaining bolts. The inner sleeve served to house the closure plug. The use of retaining bolts enabled the inner sleeve to be retrieved for servicing when the closure plug was worn to the point that unacceptable leakage was occurring. More importantly, it enabled the inner sleeve to be retrieved when immediate access was required when problems were encountered during drilling.

SUMMARY OF THE INVENTION

The present invention relates to an alternative configuration of mudsaver valve with retrievable inner sleeve.

According to the present invention there is provided a mudsaver valve with retrievable inner sleeve which includes a housing having an axis and a inner sidewall defining an interior bore. An inner sleeve is disposed within the interior bore of the housing. The inner sleeve has a first end, a second end, a central passage extending between the first end and the second end, at least one inlet passage into the central passage at the first end and at least one radial outlet passage from the central passage at the second end. An annular flow control sleeve is positioned between the inner sidewall of the housing and the second end of the inner sleeve. An annular piston is positioned between the inner sidewall of the housing and the first end of the inner sleeve. The annular piston is axially movable relative to the housing. The annular piston is secured to the first end of the inner sleeve such that movement of the annular piston results in movement of the inner sleeve relative to the annular flow control sleeve between a valve closed position and a valve open position. In the valve closed position the at least one radial outlet passage of the inner sleeve is blocked by the annular flow control sleeve. In the valve open position the inner sleeve is moved relative to the annular flow control sleeve so that the at least one radial outlet passage is no longer blocked. A biasing spring biases the annular piston to maintain the inner sleeve in the valve closed position. The inner sleeve is maintained in the valve closed position until pump pressure acting upon the inner sleeve and the annular piston overcomes the biasing force of the biasing spring causing the inner sleeve and annular piston to move to the valve open position. When pump pressure ceases, the biasing spring acts upon the annular piston which carries the inner sleeve back to the valve closed position.

The mudsaver valve, as described above, provides an alternative valve configuration which has some inherent advantages over the Bailey et al reference. The inner sleeve moves between the valve open position and the valve closed position. A positive seal is maintained even as erosion and wear occurs. In contrast, the configuration of mudsaver valve disclosed in the Bailey et al reference inevitably leaked as soon as erosion and wear began to occur.

Although the mudsaver valve disclosed in the Bailey et al reference was serviceable, the process of retrieving the retrievable sleeve would shear the retaining bolts. This made it impossible to immediately inspect and reinsert the retrievable sleeve. In contrast, with the present mudsaver valve the annular piston is detachably secured to the first end of the inner sleeve by means of a spring retaining ring. This enables inner sleeve to be removed merely by overcoming the biasing force of the spring retaining ring and then snapped back into place after inspection. It is, of course, preferred that a coupling be positioned at the first end of the inner sleeve, whereby the inner sleeve is grasped for removal.

With the mudsaver valve disclosed in the Bailey et al reference the biasing spring used was exposed to corrosive drilling fluids. With the present invention it is preferred that a lubrication port extend through the inner sidewall of the housing. This permits lubrication of the biasing spring. As long as the biasing spring remains immersed in lubricant, it is protected from the effects of corrosive drilling fluids and hydrogen sulfide gas.

Although beneficial results may be obtained through the use of the mudsaver valve, as described above, pressure differentials sometimes develop which can adversely affect the operation of the mudsaver valve. Even more beneficial results may, therefore, be obtained when a one way valve is positioned at the second end of the inner sleeve. The one way valve prevents a flow of fluids from the first end to the second end, but permits a flow of fluids from the second end to the first end should a pressure differential occur.

The configuration of mudsaver valve, as will hereinafter be further described, can be fortified against erosion through the use of carbide. It is preferred that the inlet passages be lined with carbide bushings and the radial outlet passages be lined with carbide bushings. It is also preferred that the annular flow control sleeve have a carbide bushing aligned with radial outlet passages when the inner sleeve is in the valve open position.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
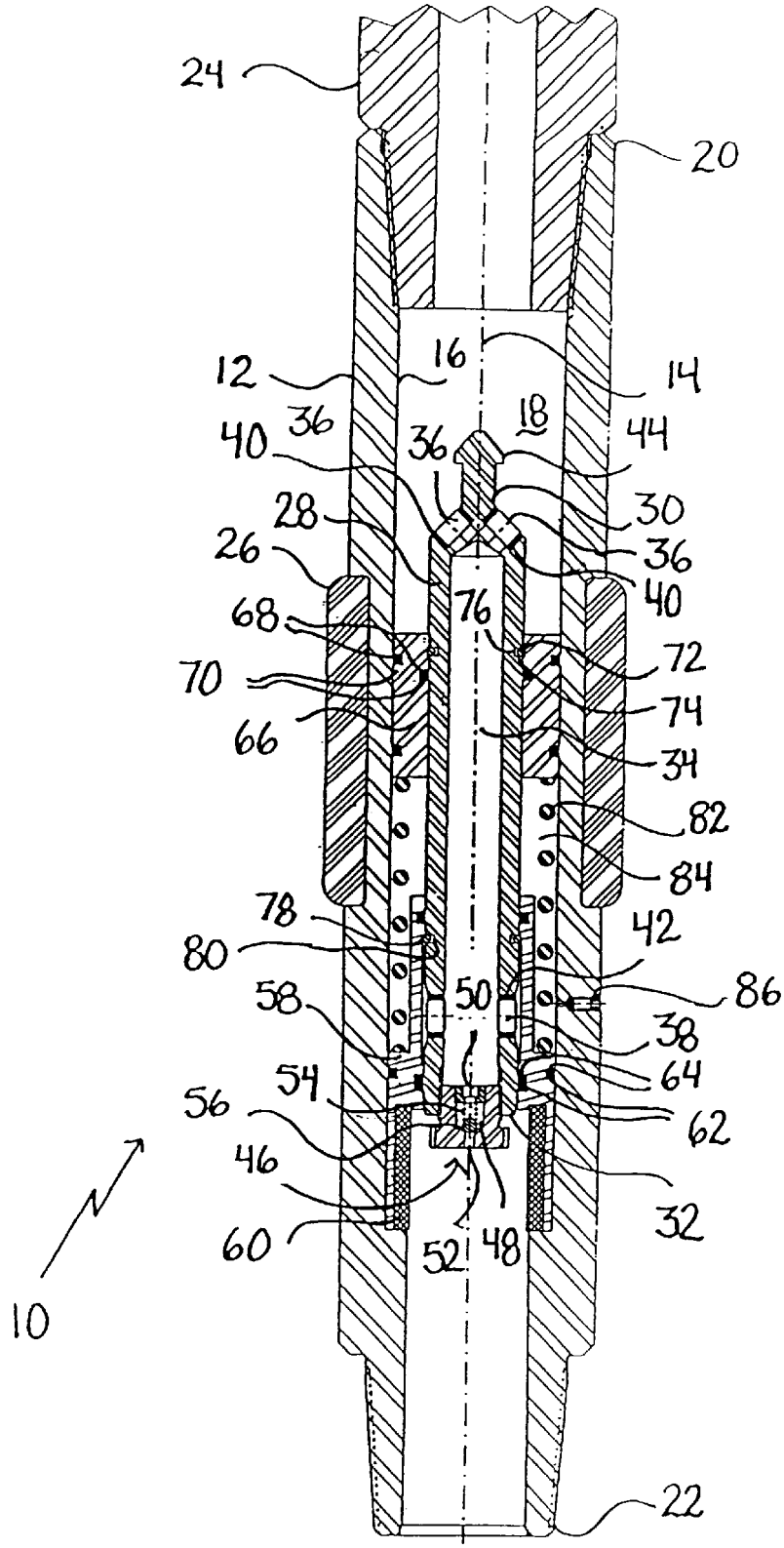
FIG. 1 is side elevation view, in section, of a mudsaver valved constructed in accordance with the teachings of the present invention with an inner sleeve in a valve closed position.

The preferred embodiment, a mudsaver valve generally identified by reference numeral 10, will now be described with reference to FIGS. 1 and 2.

Structure and Relationship of Parts:

Referring to FIG. 1, mudsaver valve 10 includes a housing 12 with an axis 14 and a inner sidewall 16 which defines an interior bore 18. Housing 12 has a first end 20 and a second end 22. A top drive unit 24 is secured to first end. An exterior sleeve 26 encircles housing 12. An inner sleeve 28 is disposed within interior bore 18 of housing 12. Inner sleeve 28 has a first end 30, a second end 32, a central passage 34 that extends between first end 30 and second end 32. Inlet passages 36 extend into central passage 34 at first end 30. Radial outlet passages 38 extend from central passage 34 at second end 32. Each of inlet passages 36 are lined with a carbide bushing 40 and each of outlet passages 38 are also lined with a carbide bushing 42.

A spear head coupling 44 is positioned at first end 30 of inner sleeve 28, whereby inner sleeve 28 is grasped for removal.

A one way valve, generally referenced by numeral 46, is positioned at second end 32 of inner sleeve 28. One way valve 46 includes a flow passage 48 with a first flow opening 50 and a second flow opening 52. Flow passage 48 of one way valve 46 contains a spring 54 which biases a ball 56 into sealing engagement with second flow opening 52. One way valve 46 prevents a flow of fluids from first end 20 to second end 22 of housing 12, but still permits a flow of fluids from second 22 end to first end 20 should a pressure differential occur.

Figure 2:
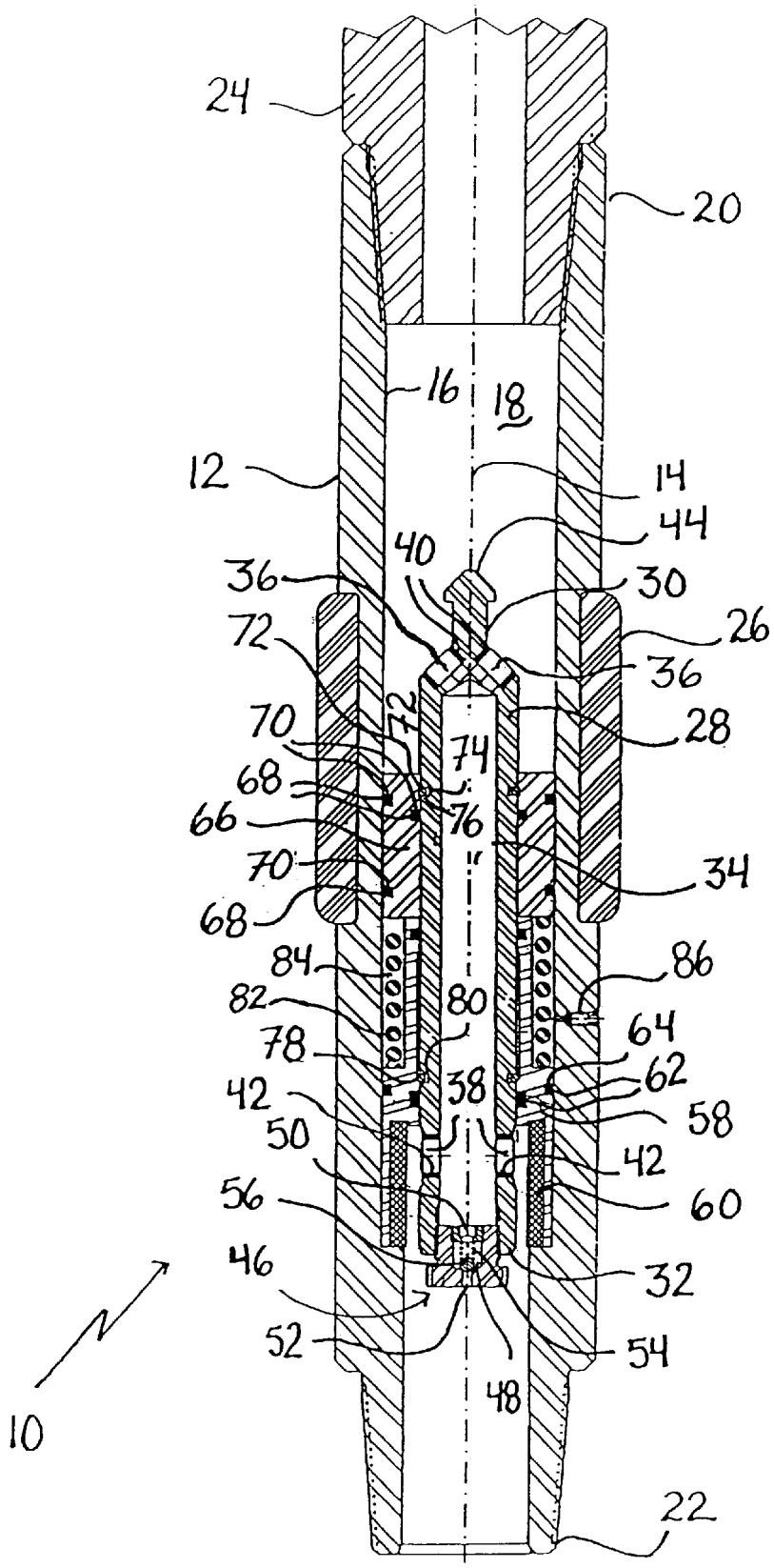
FIG. 2 is a side elevation view, in section, of the mudsaver valve illustrated in FIG. 1, with the inner sleeve in a valve open position.

Referring to FIG. 2, An annular flow control sleeve 58 is positioned between inner sidewall 16 of housing 12 and second end 32 of inner sleeve 28. Annular flow control sleeve 58 has a carbide bushing 60 that is radially aligned with radial outlet passages 38 when inner sleeve 28 is in the valve open position. Seals 62 are disposed in grooves 64 in annular flow control sleeve 58 between inner side wall 16 of housing 12 and annular flow control sleeve 58 and between inner sleeve 28 and annular control sleeve 58.

An annular piston 66 is positioned between inner sidewall 18 of housing 12 and first end 30 of inner sleeve 28. Seals 68 are disposed in grooves 70 in annular piston 66 between inner sidewall 18 of housing 12 and annular piston 66 and between inner sleeve 28 and annular piston 66. Annular piston 66 is axially movable relative to housing 12. Referring to FIGS. 1 and 2, annular piston 66 is detachably secured to first end 30 of inner sleeve 28 by a spring retaining ring 72 such that movement of annular piston results in movement of inner sleeve 28 relative to annular is flow control sleeve 58 between a valve closed position and a valve open position. Spring retaining ring 72 is held in a retaining groove 74 with an angular sidewall 76. Retaining groove 74 is positioned in annular piston 66 but also could be positioned on inner sleeve 28. Inner sleeve 28 is detachably secured to annular flow control sleeve 58 by a spring retaining ring 78 held in a retaining groove 80 in inner sleeve 28. Spring retaining ring 78 slides axially along annular flow control sleeve 58 in a reduced diameter slideway. A biasing spring 82 is disposed in a chamber 86 between annular flow control sleeve 58 and housing 12. A lubrication port 86 extends through inner sidewall 18 of housing 12 thereby permitting lubrication of biasing spring 82.

Operation:

The use and operation of mudsaver valve 10, will now be described with reference to FIGS. 1 and 2. Referring to FIGS. 1 and 2, inner sleeve moves between the valve open position to allow the downward flow of drilling mud, and the valve closed position when pumping is interrupted to retain mud. Referring to FIG. 1, in the valve closed position, radial outlet passages 38 of inner sleeve 28 are blocked by annular flow control sleeve 58. Inner sleeve 28 is maintained in the valve closed position until pump pressure upon annular piston 66 and inner sleeve 28 overcomes biasing force of biasing spring 82 to cause inner sleeve 28 to be moved to the valve open position. Referring to FIG. 2, in the valve open position, inner sleeve 28 is positioned relative to annular flow control sleeve 58 so that radial outlet passages 38 are no longer blocked.

Referring to FIGS. 1 and 2, when pump pressure stops, then biasing spring 82 biases against annular piston 66. As annular piston 66 moves it carries inner sleeve 28 to the valve closed position and maintains inner sleeve 28 in the valve closed position, until pump pressure acting upon annular piston 66 ensues again to overcome the biasing force of biasing spring 82. This will cause inner sleeve 28 to be carried by annular piston 66 to the valve open position again.

Seals 62 and seals 68 prevent drilling mud from interfering with movement of inner sleeve 28 and from entering chamber 86 and interfering with operation of biasing spring 82. To protect and maintain biasing spring 82 in chamber 86, biasing spring 82 can be lubricated through lubrication port 86.

In the event that a pressure differential occurs, one way valve 46 operates to permit a flow of fluids from second 22 end to first end 20 and yet prevents a flow of fluids from first end 20 to second end 22 of housing 12. When a pressure differential occurs, pressure causes ball 58 to overcome biasing force of spring 54 and move out of sealing engagement with second flow opening 52 to permit the flow of fluids from second flow opening 52 though to first flow opening 50.

Should inner sleeve 28 need to be inspected or replaced, annular piston 66 is detachably secured to first end 30 of inner sleeve 28 by spring retaining ring 72 so that inner sleeve 28 can be quickly removed by overcoming the biasing force of spring retaining ring 72. After inspection, if a replacement inner sleeve 28 is required, a new inner sleeve 28 can then be snapped back into place, and mudsaver valve 10 can resume operation.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A mudsaver valve with retrievable inner sleeve, comprising:

a housing having an axis and a inner sidewall defining an interior bore;

an inner sleeve disposed within the interior bore of the housing, the inner sleeve having a first end, a second end, a central passage extending between the first end and the second end, at least one inlet passage into the central passage at the first end and at least one radial outlet passage from the central passage at the second end;

an annular flow control sleeve positioned between the inner sidewall of the housing and the second end of the inner sleeve;

an annular piston positioned between the inner sidewall of the housing and the first end of the inner sleeve, the annular piston being axially movable relative to the housing, the annular piston being secured to the first end of the inner sleeve such that movement of the annular piston results in movement of the inner sleeve relative to the annular flow control sleeve between a valve closed position and a valve open position, in the valve closed position the at least one radial outlet passage of the inner sleeve being blocked by the annular flow control sleeve, in the valve open position the inner sleeve is moved relative to the annular flow control sleeve so that the at least one radial outlet passage is no longer blocked; and a biasing spring biases the annular piston to maintain the inner sleeve in the valve closed position, such that the inner sleeve is maintained in the valve closed position until pump pressure acting upon the inner sleeve and the annular piston overcomes the biasing force of the biasing spring causing the inner sleeve and annular piston to move to the valve open position, when pump pressure ceases the biasing spring acts upon the annular piston which carries the inner sleeve back to the valve closed position.

2. The mudsaver valve as defined in claim 1, wherein a coupling is positioned at the first end of the inner sleeve, whereby the inner sleeve is grasped for removal.

3. The mudsaver valve as defined in claim 1, wherein a one way valve is positioned at the second end of the inner sleeve, the one way valve preventing a flow of fluids from the first end to the second end, but permits a flow of fluids from the second end to the first end should a pressure differential occur.

4. The mudsaver valve as defined in claim 1, wherein at least one lubrication port extends through the inner sidewall of the housing, thereby permitting lubrication of the biasing spring.

5. The mudsaver valve as defined in claim 1, wherein the annular piston is detachably secured to the first end of the inner sleeve by means of a retaining ring.

6. The mudsaver valve as defined in claim 1, wherein the at least one inlet passage is lined with a carbide bushing.

7. The mudsaver valve as defined in claim 1, wherein the at least one radial outlet passage is lined with a carbide bushing.

8. The mudsaver valve as defined in claim 1, wherein the annular flow control sleeve has a carbide bushing radially aligned with the at least one radial outlet passage when the inner sleeve is in the valve open position.

9. A mudsaver valve with retrievable inner sleeve, comprising:

a housing having an axis and a inner sidewall defining an interior bore;

an inner sleeve disposed within the interior bore of the housing, the inner sleeve having a first end, a second end, a central passage extending between the first end and the second end, at least one inlet passage into the central passage at the first end and at least one radial outlet passage from the central passage at the second end;

a spear head coupling positioned at the first end of the inner sleeve, whereby the inner sleeve is grasped for removal;

a one way valve positioned at the second end of the inner sleeve, the one way valve preventing a flow of fluids from the first end to the second end, but permitting a flow of fluids from the second end to the first end should a pressure differential occur;

an annular flow control sleeve positioned between the inner sidewall of the housing and the second end of the inner sleeve;

an annular piston positioned between the inner sidewall of the housing and the first end of the inner sleeve, the annular piston being axially movable relative to the housing, the annular piston being detachably secured to the first end of the inner sleeve by a spring retaining ring such that movement of the annular piston results in movement of the inner sleeve relative to the annular flow control sleeve between a valve closed position and a valve open position, in the valve closed position the at least one radial outlet passage of the inner sleeve being blocked by the annular flow control sleeve, in the valve open position the inner sleeve is moved relative to the annular flow control sleeve so that the at least one radial outlet passage is no longer blocked, the inner sleeve being removable from the annular piston when an overshot connected the spear head coupling exerts a force upon the inner sleeve which overcomes the biasing force of the spring retaining ring;

a biasing spring biases the annular piston to maintain the inner sleeve in the valve closed position, such that the inner sleeve is maintained in the valve closed position until pump pressure acting upon the inner sleeve and the annular piston overcomes the biasing force of the biasing spring causing the inner sleeve and annular piston to move to the valve open position, when pump pressure ceases the biasing spring acts upon the annular piston which carries the inner sleeve back to the valve closed position;

at least one lubrication port extends through the inner sidewall of the housing, thereby permitting lubrication of the biasing spring.

10. The mudsaver valve as defined in claim 9, wherein the at least one inlet passage is lined with a carbide bushing.

11. The mudsaver valve as defined in claim 9, wherein the at least one radial outlet passage is lined with a carbide bushing.

12. The mudsaver valve as defined in claim 9, wherein the annular flow control sleeve has a carbide bushing radially aligned with the at least one radial outlet passage when the inner sleeve is in the valve open position.

13. The mudsaver valve as defined in claim 9, wherein the spring retaining ring is held in a retaining groove with an angular sidewall, the retaining groove being positioned in one of the annular piston or the inner sleeve.

14. The mudsaver valve as defined in claim 9, wherein the inner sleeve is detachably secured to the annular flow control sleeve by a spring retaining ring held in a retaining groove in the inner sleeve, the spring retaining ring sliding axially along the annular flow control sleeve in a reduced diameter slideway.

* * * * *